United States Patent [19]

Kasuya

[11] 4,101,241

[45] Jul. 18, 1978

[54] SUPER CHARGER WITH FLUID BIASED HEAT SHROUD

[75] Inventor: Tamotsu Kasuya, Oyama, Japan

[73] Assignee: Kabushiki Kaisha Komatsu Seisakusho, Tokyo, Japan

[21] Appl. No.: 687,905

[22] Filed: May 19, 1976

[51] Int. Cl.[2] ..... F01D 5/08; F01D 25/08

[52] U.S. Cl. ..... 415/113; 415/170 A; 415/178; 417/407

[58] Field of Search ..... 415/178, 113, 170 A, 415/109, 110, 111, 112; 277/3, 13, 15, 27; 417/407; 60/39.08

[56] References Cited

U.S. PATENT DOCUMENTS

| | | | |
|---|---|---|---|
| 2,492,672 | 12/1949 | Wood | 415/113 X |
| 2,730,954 | 1/1956 | Hornschuch | 415/113 |
| 2,873,945 | 2/1959 | Kuhn | 415/178 X |
| 3,068,801 | 12/1962 | Murray | 415/109 |
| 3,408,043 | 10/1968 | Williams et al. | 415/113 |
| 3,652,180 | 3/1972 | Choquette et al. | 415/113 |
| 3,754,834 | 8/1973 | Wolters | 415/113 X |

FOREIGN PATENT DOCUMENTS

| | | | |
|---|---|---|---|
| 625,898 | 7/1949 | United Kingdom | 415/113 |
| 896,482 | 5/1962 | United Kingdom | 415/113 |

*Primary Examiner*—Carlton R. Croyle
*Assistant Examiner*—Donald S. Holland
*Attorney, Agent, or Firm*—Armstrong, Nikaido, Marmelstein & Kubovcik

[57] ABSTRACT

A supercharger comprising a center housing, a turbine casing mounted on said center housing, a turbine shaft rotatably supported within said center housing, said turbine shaft having a turbine impeller at one end thereof within said turbine casing, a seal provided on said turbine shaft to prevent lubricant leakage from said center housing to said turbine casing, a heat shroud mounted on said turbine shaft between said center housing and said turbine casing, and a pressure hole formed in said heat shroud which permits communication of the inner and outer parts thereof thereby applying a high pressure in the inside part of said heat shroud to enhance sealing effect of said seal.

3 Claims, 2 Drawing Figures

SUPER CHARGER WITH FLUID BIASED HEAT SHROUD

BACKGROUND OF THE INVENTION

This invention relates to a supercharger.

In superchargers which have heretofore been employed, the lubricant supplied through an inlet port is fed to a thrust bearing and a journal bearing, and the leakage of the lubricant to the turbine side is prevented by an oil seal mounted on the turbine side. An engine blow-by pressure is exerted on the inside of a center housing through a lubricant outlet pipe. Further, because the clearance between a turbine impeller and a heat shroud is comparatively small, the part of the turbine impeller near a seal ring tends to be subjected to a pressure much lower than the gas pressure at the turbine inlet.

In the case the supercharger is driven under such condition for a long time, the lubricant to lubricate the seal ring tends to leak through the back surface of the turbine impeller towards the inside of the turbine casing and the parts joining the center housing and the turbine casing thereby causing fire hazards or forming carbon deposits therebetween to give bad influence on the supercharger itself.

SUMMARY OF THE INVENTION

According to the present invention it is provided a supercharger comprising a center housing having an inlet and an outlet for lubricant; a turbine casing mounted on said center housing; a turbine shaft rotatably supported within said center housing, said turbine shaft having a turbine impeller at one end thereof within said turbine casing; sealing means provided on said turbine shaft to prevent lubricant leakage from said center housing to said turbine casing; a heat shroud mounted on said turbine shaft between said center housing and said turbine casing; and means provided on said heat shroud which permits communication of the inside and outside thereof thereby applying, a high pressure in the inside of said heat shroud to enhance sealing effect of said sealing means.

It is, therefore, an object of the present invention to provide a supercharger provided with a lubricant leakage preventive device. Another object of the present invention is to provide a supercharger in which lubricant leakage through said seal ring to the turbine casing can be prevented by making the pressure at the turbine side of said seal ring higher than the pressure within the center housing. Another objects, features and advantages of the present invention will be readilly apparent from the following description taken in conjunction with following drawings.

DETAILED DESCRIPTION OF THE PREFERRED EMBODIMENTS

Figure 1:
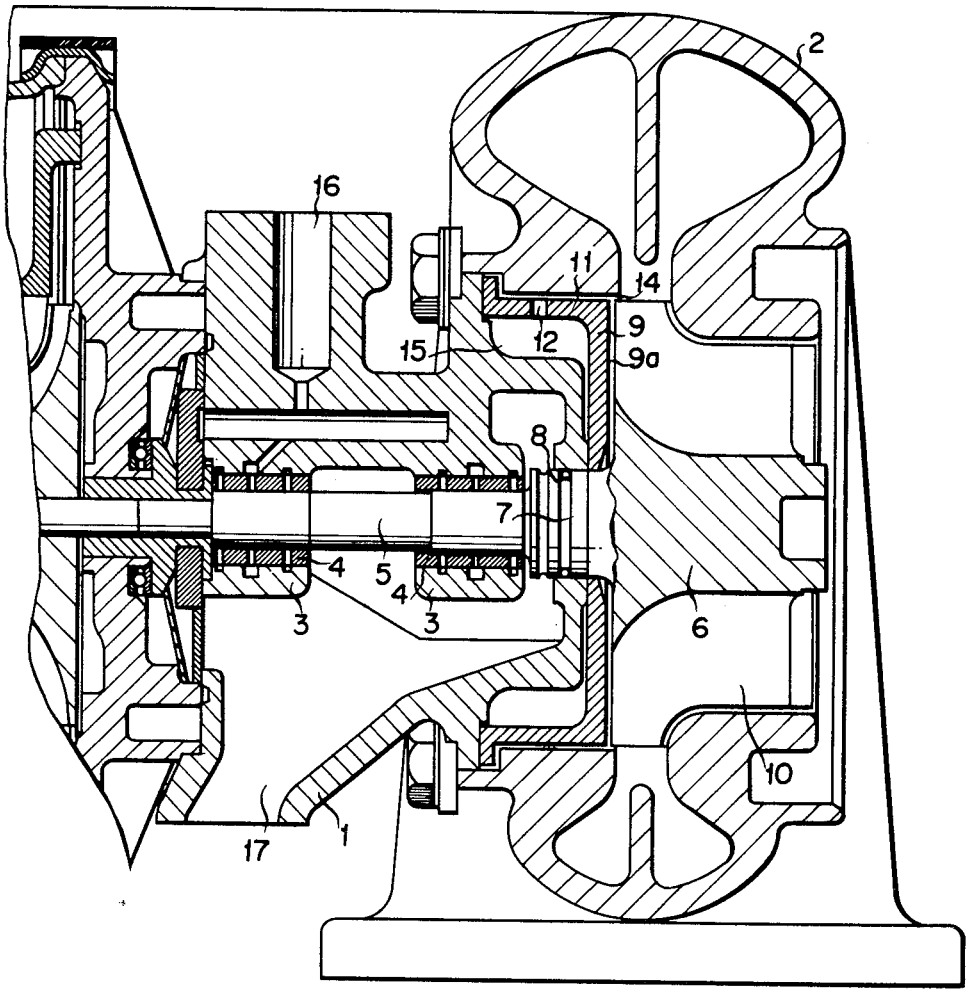
FIG. 1 is a cross-sectional view of the present invention.
Figure 2:
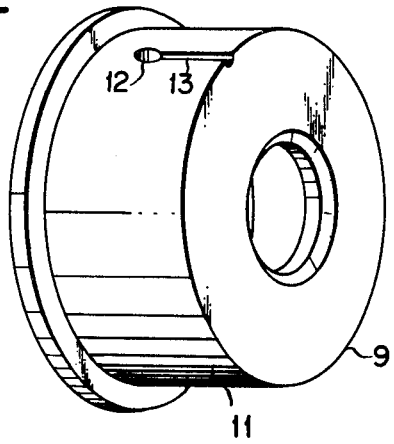
FIG. 2 is a perspective view showing one embodiment of the heat shroud of the present invention.

The present invention will now be described in detail below by way of example only with reference to FIGS. 1 and 2. Reference numeral 1 denotes a center housing and 2 a turbine casing. A turbine shaft 5 is rotatably supported through journal bearings 4, 4 by shaft journals 3, 3 provided within the center housing 1. The turbine shaft 5 has a turbine impeller 6 formed thereon. Further, the turbine shaft 5 has a shaft seal portion 7 formed thereon. A seal ring 8 is mounted on the shaft seal portion 7. A heat shroud 9 is mounted on the turbine side of the center housing 1 so that terminal face **9*a* of the heat shroud is located opposite to a turbine impeller 10. The heat shroud 9 comprises a cylindrical portion 11 having a pressure hole 12 formed thereon. In brief, arrangement is made such that clearance 14 between the turbine casing 2 and the heat shroud 9 is permitted to communicate through the pressure hole 12 with the inside part 15 of the heat shroud 9. Reference numeral 16 denotes an inlet for lubricant, and 17** an outlet therefor.

A gas static pressure is exerted through the clearance 14 formed between the heat shroud 9 and the turbine casing 2 and through the pressure hole 12 on the inside part 15 of the heat shroud 9. The pressure within the inside part 15 can be increased to about three times as high as the pressure within the center housing 1 or 300 to 600 mmAq. approximately. By thus making the pressure applied on the turbine side of the center housing 1 higher than the pressure within the center housing 1, leakage of the lubricant through the seal ring to the turbine casing can be completely prevented.

Furthermore, the clearance 14 between the turbine casing 2 and the heat shroud 9 is about 0.25 to 0.5 mm. However, for those having no such clearance a groove 13 may be formed, as an alternative, on the outer periphery of the cylindrical portion 10 of the heat shroud 9.

As described in detail hereinabove, according to the present invention, a pressure hole 12 is formed in the cylindrical portion 11 of the heat shroud 9 interposed between the center housing 1 and the turbine casing 2 to permit communication of the inside and outside parts of the heat shroud 9 so that a gas static pressure about three times as high as the pressure within the center housing 1 can be exerted on the inside part of the heat shroud 9. For this reason, the pressure exerted on the seal ring on the turbine side thereof can be kept higher than the pressure within the center housing 1 so that oil leaks through the seal ring to the turbine casing can be completely prevented.

It is to be understood that the above description is by way of example only, and that details for carrying the present invention into effect may be varied without departing from the scope of the present invention claimed.

What is claimed is:

1. A supercharger, comprising:

a center housing having an inlet and an outlet for a lubricant;

a turbine casing mounted on said center housing;

a turbine shaft rotatably supported within said center housing, said turbine shaft having a turbine impeller at one end thereof within said turbine casing;

sealing means provided on said turbine shaft to prevent lubricant leakage from said center housing to said turbine casing;

a heat shroud mounted on said turbine shaft between said center housing and said turbine casing; and pressure means provided on said heat shroud which permits communication of the inside and outside thereof thereby applying the pressure on the outside of said heat shroud to the inside of said heat shroud whereby the pressure on the inside of said heat shroud is greater than the pressure in said center housing thereby enhancing the sealing effect of said sealing means.

2. A supercharger according to claim 1 wherein said pressure means is a pressure hole through said heat shroud.

3. A supercharger according to claim 1 wherein said heat shroud has a groove formed thereon, one end of said groove being open to the inside of said turbine casing and the other end thereof being open to said pressure means on said heat shroud.

* * * * *